United States Patent [19]

Holding et al.

[11] 4,325,901

[45] Apr. 20, 1982

[54] METHOD OF BRUSH MANUFACTURE

[75] Inventors: David Holding, Bolton; John D. Chancellor, Mickleover, both of England

[73] Assignee: Schlegel (UK) Limited, Leeds, England

[21] Appl. No.: 165,788

[22] Filed: Jul. 3, 1980

[51] Int. Cl.[3] ..... B29C 24/00; B29C 17/00

[52] U.S. Cl. ..... 264/146; 264/167; 264/171; 264/174; 264/243; 264/248; 300/21

[58] Field of Search ..... 425/805; 264/243, 248, 264/103, 146, 174, 167, 171; 300/19, 21

[56] References Cited

U.S. PATENT DOCUMENTS

| | | | |
|---|---|---|---|
| 2,576,546 | 11/1951 | Starr | 300/21 |
| 2,643,157 | 6/1953 | Hardman et al. | 300/21 |
| 2,672,640 | 3/1954 | Peterson et al. | 425/805 |
| 3,072,945 | 1/1963 | Peterson | 300/21 |
| 3,342,817 | 9/1967 | Young | 264/248 |
| 3,351,387 | 11/1967 | Lechene | 300/21 |
| 3,551,936 | 1/1971 | Kutik et al. | 425/805 |
| 4,133,147 | 1/1979 | Swift, Jr. | 300/21 |

FOREIGN PATENT DOCUMENTS

| | | | |
|---|---|---|---|
| 677457 | 1/1964 | Canada | 264/243 |
| 884492 | 7/1953 | Fed. Rep. of Germany | 300/21 |
| 756749 | 9/1956 | United Kingdom | 300/21 |

*Primary Examiner*—James B. Lowe

*Attorney, Agent, or Firm*—Cumpston & Shaw

[57] ABSTRACT

A method of manufacturing brushes wherein two brush tapes which are formed of synthetic resinous material and incorporate a plurality of bristle filaments held together by a knitting operation or a weaving operation or by means of an extruded bead are arranged adjacent each other and held in this relationship by means of a bead of synthetic resinous material running along one side edge of the tapes. This bead may be extruded around the adjacent edges of the tapes or if beads of plastics material are already present on the tapes, may be formed by fusing the two beads together. There may be more than two adjacent tapes which may be arranged side-by-side or at an angle to each other or spaced apart and the construction of the tapes can be the same or different. Furthermore, one or more barrier layers may be located between the tapes. It is even envisaged that un-beaded tapes could be fused together, and the bead would then be formed by a forming operation.

30 Claims, 8 Drawing Figures

METHOD OF BRUSH MANUFACTURE

This invention relates to a method of manufacturing brushes.

In U.K. patent Specification No. 730131, a method of manufacturing brush strips is disclosed wherein an organic material is heated to plastic state and is extruded through a mouthpiece into a continuous U-shaped strip through a groove-shaped guide member, whereupon a plurality of aligned bristles are conveyed by means of an endless belt together with a thread of metal and are folded around a guide cam and led into the open topped guide member. The guide member has a tapering slot in its upper surface at the bristle feed-in location, and as the bristles are advanced and the U-shaped strip is pulled out of the guide member, so the bristles are folded with their ends upwards by the narrow slot, and pressed down into the U-shaped strip. In this way, the side walls of the U-shaped strip are pressed against the bristles which are partly pressed into the soft material of the strip and held therein. It is preferred that the strip is cooled on emergence from the extruder so that it maintains its shape better.

Brush strips made in accordance with the above teachings are wholly unsatisfactory in that, due to the low temperature of the U-shaped strip, the bristles are only pressed into its surface and cannot even form a satisfactory mechanical key with the strip. This means that after a few uses, the bristles tend to fall out of the strip.

In our U.S. Pat. No. 4,133,147, a method of manufacturing brush components is disclosed wherein a plurality of endless bristle filaments are folded into a zig-zag formation and held in that position by means of threads knitted into the zig-zag, the resultant tape then being slit centrally and having plastics locking beads extruded onto it either before or after slitting.

In our subsequent co-pending U.S. patent Application Ser. No. 165,790, further methods of brush construction are disclosed wherein beads of plastics material are extruded onto aligned cut bristle elements held between endless haul-off belts.

In our U.S. patent Application Ser. No. 165,789 we disclose a method of manufacturing brush components wherein a weft formed from a tow of endless bristle elements is woven with suitable warp yarns to provide a woven fabric which subsequently has plastics beads extruded onto it transverse to the tow wefts and is slit into brush component tapes.

The various longitudinally extending knitted, cut bristle or woven brush components the subject of the above specifications but without their extruded plastics beads—either slit longitudinally so as to remove one edge, or unslit—will hereinafter be referred to as brush tapes as hereinbefore defined. The components which already have a bead on them will be referred to as beaded brush strips as hereinbefore defined.

The present invention seeks to provide an improved method of manufacturing brushes, which method incorporates the use of brush tapes or beaded brush strips as hereinbefore defined.

According to the present invention, we provide a method of manufacturing a brush component wherein at least two brush tapes having a plurality of aligned bristles are arranged adjacent each other and are held in this relationship by means of a bead of synthetic resinous material running along one side edge of the tapes, the said bead acting as an anchoring device for securing the brush component in a brush holder.

In one construction, for example, if the tapes are knitted or woven tapes, the two tapes can be held in abutting side-by-side relationship and have the bead extruded along their abutting side edges by passing the tapes together through an extruder. However, instead of extruding a bead, it could be formed by passing the tapes through a fusion head. Alternatively, if the tapes are formed by different methods and/or already have beads along their side edges, then the existing beads along their side edges can be fused together to provide a single anchoring bead.

If desired, several tapes may be arranged in side-by-side relationship and these may be of similar or of different construction. For example, the tapes may be formed of the same or different bristle components or they may be of different densities or thickness or the bristles or tows or bundles into which they are formed may be of different diameter.

In order to strengthen the brush component, a carrier may be incorporated in the bead and this may be in the form of a coated or uncoated wire or textile filament. If a wire is provided, this will means that if the component is bent to a particular shape, it will maintain that shape.

In a particular embodiment of this invention, one or more barrier layers, e.g. cloths or impervious membranes, may be incorporated into the component. The membrane can be a single sheet of plastics material located between the two tapes, e.g. a polymeric sheet which would fuse with the material of the bead, or, alternatively, a plurality of individual overlapping membranes could be provided. If desired, the membrane may be pre-formed into a generally pleated construction and by spacing the two brush tapes slightly apart, the pleated membrane can then be accommodated between the tapes. Obviously, the closer together the tapes are located, the more the bristles on each side of the tape will be accommodated in the indentations provided by the pleats. With such a construction, the resultant brush component would not lose any of its flexibility in the longitudinal direction and could be flexed easily about its bead, and if an impervious membrane is used, the brush could be largely waterproof.

If desired, the two or more tapes making up the brush component could be orientated relative to each other so that instead of lying side-by-side, they are inclined to each other with only the edges of the tapes to which the bead is applied being adjacent each other.

Alternatively, the tapes could be slightly spaced apart.

In both these constructions, a membrane may also be provided between the tapes.

BRIEF DESCRIPTION OF THE DRAWINGS

Referring to FIG. 1, two knitted brush tapes 1 (as disclosed in our U.S. Pat. No. 4,133,147) are fed in the direction of the arrow A into an extruder E, together with a strengthening wire 3 (this may be omitted), and are brought together; a bead 5 of synthetic resinous material is then extruded onto one pair of adjacent edge portions of the tapes 1. Either before or during the extrusion operation, the adjacent edge portions are heated to a temperature sufficient at least to soften them and preferably sufficient to fuse them together. On emerging from the extruder E, a cutter K slices the bottom looped edges off the tapes, whereupon the warps W from the knitted tapes are removed by pulling.

Figure 2:
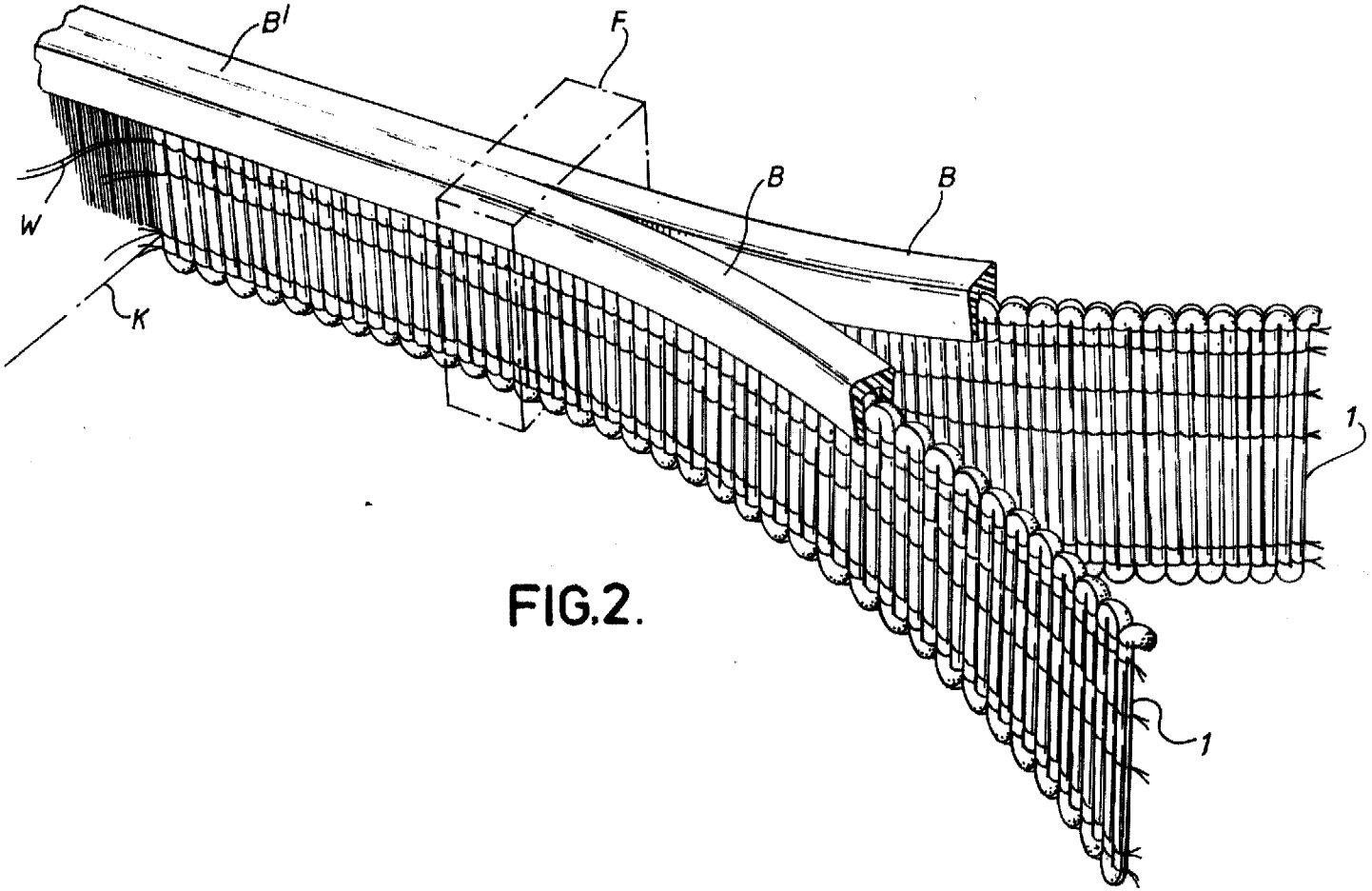

In the construction shown in FIG. 2, two tapes 1, onto edge regions of which thermoplastics beads B have already been extruded, i.e. beaded brush strips as hereinbefore described, are brought together and fed into a fusion head F, and the two beads B are fused into a single bead B'. Thereupon the component is slit and the warps W are removed as before.

Figure 1:
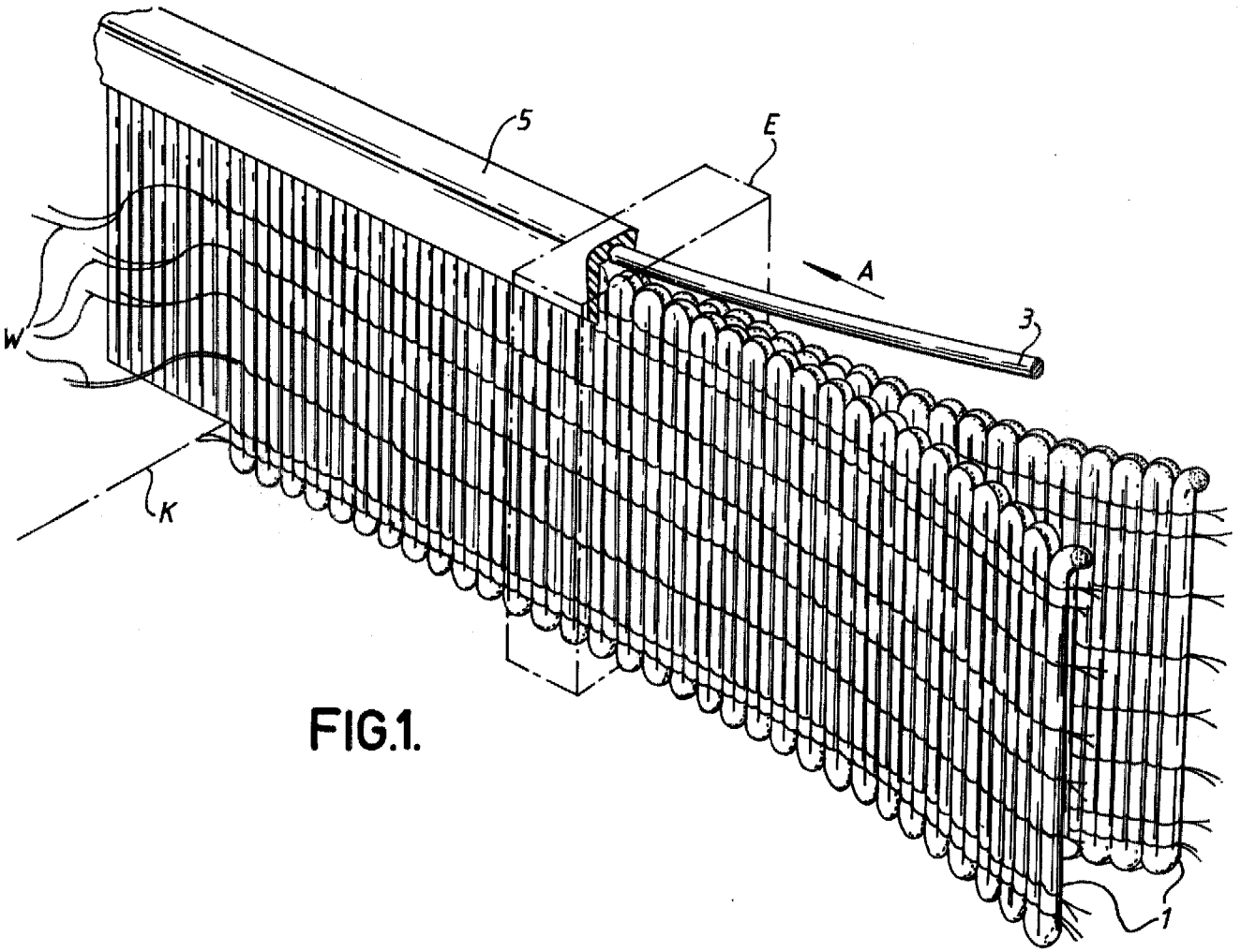
FIGS. 1-8 are perspective views of the different embodiments of the invention in which like parts have the same reference numerals.
Figure 3:
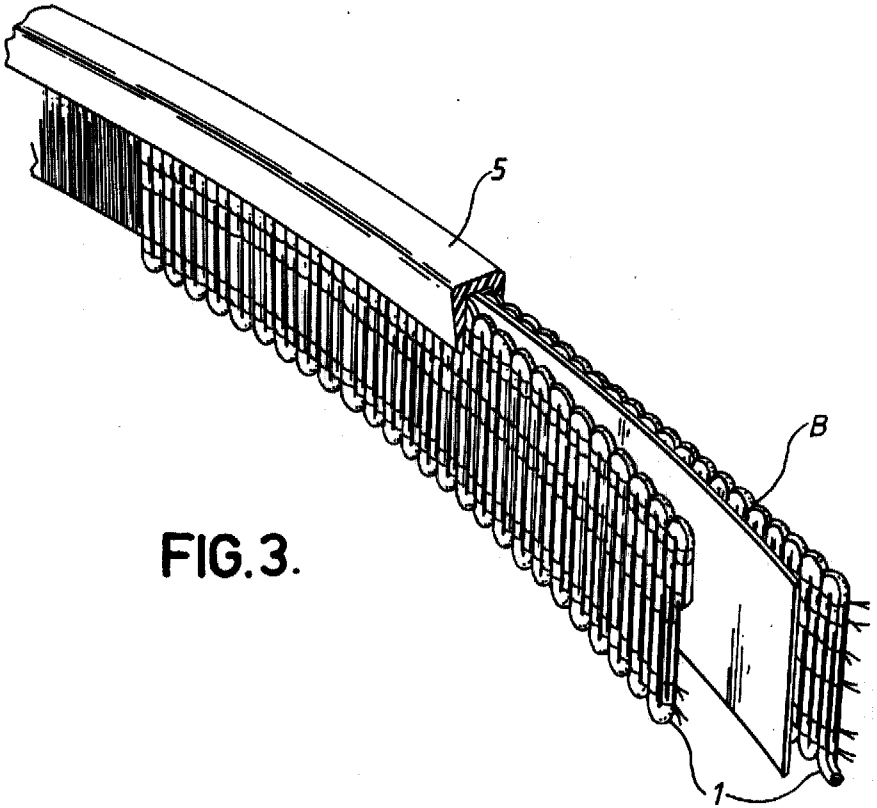

The method shown in FIG. 3 is similar to that of FIG. 1, although in this case, a barrier fin 8, e.g. a thin film of the same thermoplastic material as the bristle in the tapes 1, is fed into the extruder (not shown), between the tapes 1, and is held in position by the extruded bead 5.

Figure 4:
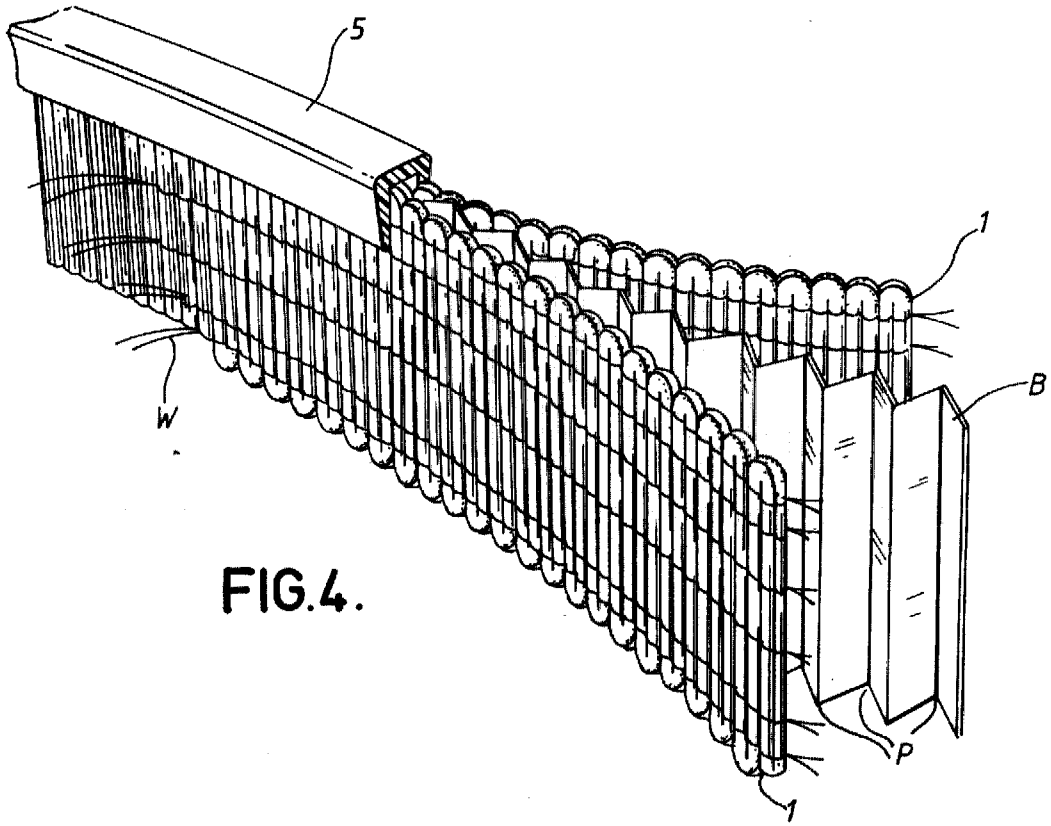

The method shown in FIG. 4 is similar to that of FIG. 3, but in this case, the barrier fin is pleated, as shown at P.

Figure 5:
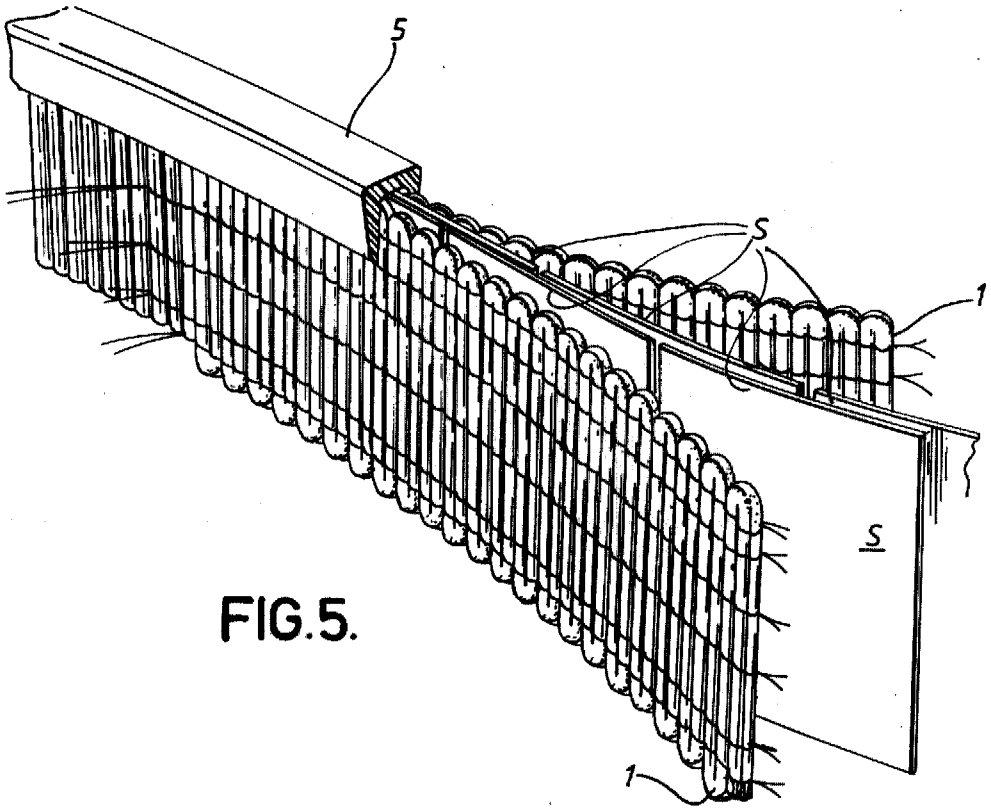

In the modified method of FIG. 5, a two-layer barrier fin is provided by two rows of sheets S of thermoplastic film, the sheets S being staggered so that the gaps in one row are covered by sheets S in the other row.

In the embodiments of both FIGS. 4 and 5, the barrier fins are designed to provide maximum flexibility in the finished brush component.

Figure 6:
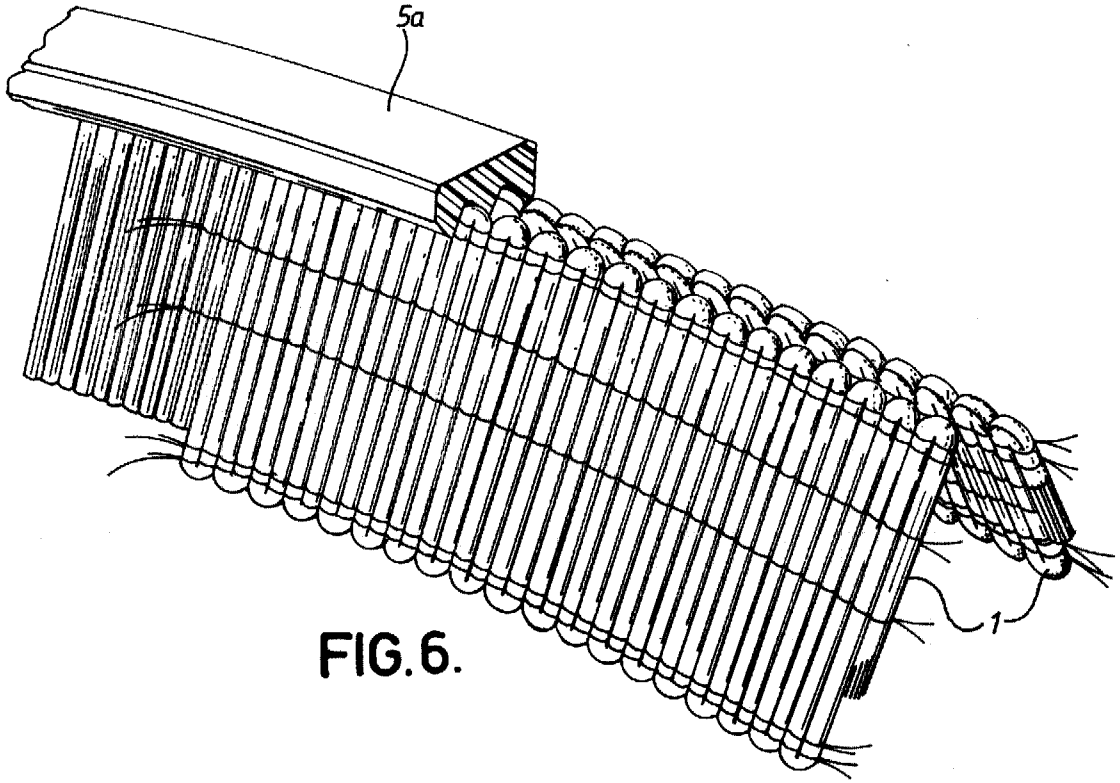

The construction shown in FIG. 6 differs from the others in that the brush tapes 1, instead of being located side by side, have one edge adjacent that of the other tape, but they are splayed outwardly, so as to be inclined with respect to one another at an acute angle of about 40° (this can vary). As a result, a fatter bead 5*a* is extruded over the adjacent edges.

Figure 7:
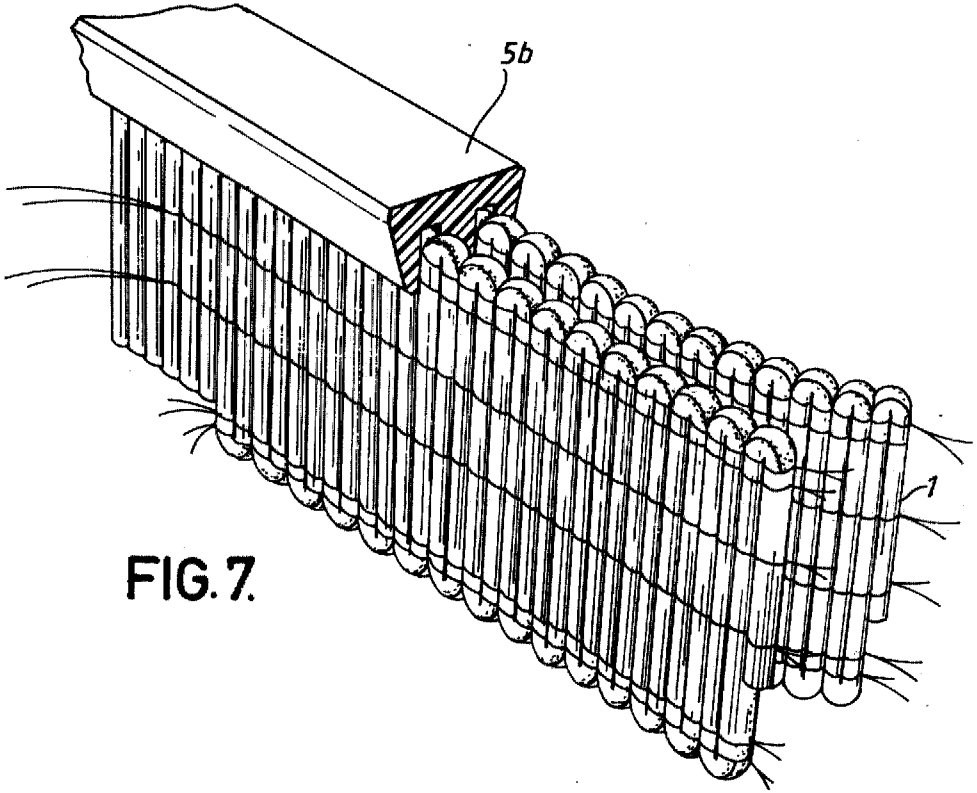

The construction shown in FIG. 7 is similar to that shown in FIG. 1 (but without the wire 3), except that two different tapes 1 and 2 are used. The tape 2 is made of a bundle of bristles which is fatter than that of the tape 1, thus providing in the finished product different bristle characteristics. Furthermore, the tapes are spread apart, and a wide bead 5*b* is therefore required.

Figure 8:
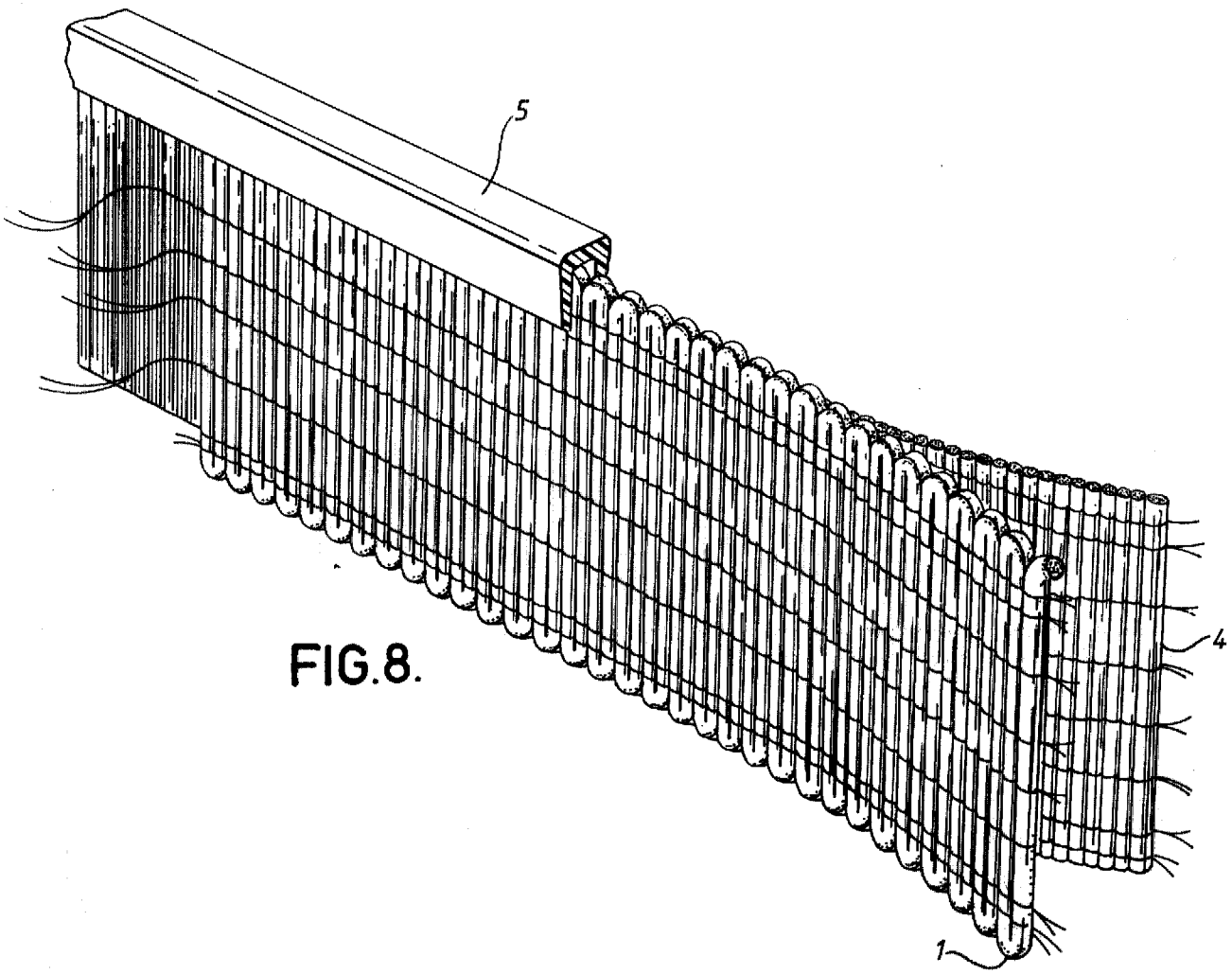

Likewise, in the construction of FIG. 8, two different tapes 1 and 4 are shown, the tape 4 being made by a weaving operation, as disclosed in our U.S. patent Application Ser. No. 165,789.

Many different constructions have been described above and it will be appreciated that brush components can also be made in accordance with the invention by taking various different features of the different Figure embodiments and combining them. For example, a woven tape 4 could be combined with a tape 1 in the method of FIG. 1, or the wire 3 (which could be plastic coated) could be used in any of the methods of FIGS. 2–8. Likewise, one of the different barrier constructions could be used in any of the methods illustrated without a barrier or fin. Also, the tapes can be inclined in any of the constructions, as shown in FIG. 6, or one (or more) tapes 2 could be combined with a different tape (e.g. 1 or 4) in any of the constructions of FIGS. 1–6.

It should also be borne in mind that where an extruder is used, the tapes will be heated, and the extruder is specially designed to soften the tapes prior to extrusion in the vicinity of the extruded beads. By choosing the correct material for the bristle filaments, and the correct temperature for the extruder, and by having the same material as the bristles for the extruded beads, it is possible to cause complete fusion between the bristle filament portions in the vicinity of the extrusion, and between said portions and the extruded bead itself. The fusion of the bristle filament portions can take place before or during the extrusion operation.

It is also possible for two or more brush tapes to be fused together without an extrusion step by passing the tapes through a suitable heating device, and the molten tape portion can then be formed into a bead.

In all the constructions, the extruded bead on the component is designed for location in a groove in a brush holder, and to lock the component into the groove, if necessary with an adhesive. This may not be necessary if the groove is re-entrant in cross-section.

What is claimed is:

1. A method for manufacturing a brush component from at least two brush tapes, each tape formed of a plurality of synthetic resinous bristle filaments and having a uniform cross-section from one side edge region to the opposite side edge region comprising the steps of:

arranging the brush tapes with the bristle filaments adjacent each other in aligned side-by-side relation;

passing the brush tapes through an extruder in one direction with the adjacent filaments lying at right angles to the one direction;

heating adjacent side edge regions of the tapes by the heat of the extruder as the tapes are advanced through the extruder so as at least to soften the side edge regions of the tapes; and extruding from the extruder a bead of synthetic resinous material along the softened adjacent side edge regions of the tapes as they are advanced whereby the bead fuses with the side edge regions and bristle filaments therein so as to hold the tapes in adjacent relationship, the bead also acting as an anchoring device for securing the brush component in a brush holder.

2. A method according to claim 1 wherein the bristle filaments are held together by warps, and the warps are pulled out of the tapes after the extrusion operation.

3. A method according to claim 1 wherein said tapes are of the same construction.

4. A method according to claim 1 wherein said tapes are of different construction.

5. A method according to claim 4 wherein said tapes have different bristle components.

6. A method according to claim 4 wherein said tapes are of different densities.

7. A method according to claim 4 wherein said tapes are of different thickness.

8. A method according to claim 4 wherein the bristles are of different diameter.

9. A method according to claim 4 wherein the tows or bundles into which the bristles are formed are of different diameter.

10. A method according to claim 1 wherein a strengthening carrier is incorporated into said bead.

11. A method according to claim 10 wherein said carrier is a coated or uncoated wire.

12. A method according to claim 1 wherein at least one barrier layer is incorporated in the component.

13. A method according to claim 12 wherein said barrier layer is a single sheet of plastics material located between the two tapes.

14. A method according to claim 12 wherein said barrier layer is comprised of a plurality of individual overlapping membranes.

15. A method according to claim 13 wherein said barrier layer is pre-formed into a generally pleated construction.

16. A method according to claim 15 wherein respective bundles of bristle forming said tapes are located, one in each indentation provided by the pleats, those bundles of one tape being accommodated on one side of the membrane and those of the other on the other side.

17. A method according to claim 1 wherein said at least two tapes are orientated relative to each other so that instead of lying side-by-side, they are inclined to each other with only the edges of the tapes to which the bead is applied being adjacent each other.

18. A method according to claim 1 wherein said tapes are slightly spaced apart and held together by a bridging bead.

19. A method according to claim 1 wherein the edge opposite the bead is slit off the tapes when the latter emerges from the extruder.

20. A method of manufacturing a brush component from at least two beaded brush strips, each strip formed of a plurality of synthetic resinous bristle filaments comprising the steps of:

arranging the beaded brush strips with the beaded portions and bristle filaments adjacent each other in aligned side-by-side relation;

positioning at least one barrier fin of synthetic resinous material between the beaded brush strips and aligned therewith with a side edge region of the fin and beaded portions forming a sandwich; and subjecting the sandwich to heat wherein the beaded portions and side edge region of the fin are fused and formed so as to enable the brush component to be secured to a support.

21. A method according to claim 20 wherein a strengthening wire is incorporated in said fused beads.

22. A method according to claim 20 wherein said two beaded brush strips are inclined relative to each other when viewed from the end.

23. A method of manufacturing a brush component from at least two brush tapes, each tape formed of a plurality of synthetic resinous bristle filaments and having a uniform cross-section from one side edge region to the opposite side edge region comprising the steps of:

arranging the brush tapes with the bristle filaments adjacent each other in aligned side-by-side relation;

positioning at least one barrier fin of synthetic resinous material between the brush tapes and aligned therewith with a side edge region of the fin and side edge regions of the tapes forming a sandwich;

subjecting the sandwich to heat in a fusion head wherein the side edge regions of the fin and tapes are fused together; and forming the fused side edge regions of the fin and tapes into a mounting portion enabling the brush component to be secured to a support.

24. A method according to claim 23 wherein the edge opposite the fused edge regions is slit off the tapes when the latter emerges from the fusion head.

25. A method according to claim 23 wherein the bristle filaments are held together by warps, and the warps are pulled out of the tapes after the fusion operation.

26. A method of manufacturing a brush component from at least two beaded brush strips, one strip formed of a plurality of synthetic resinous bristle filaments of one characteristic, and the other strip formed of a plurality of synthetic resinous bristle filaments of a different characteristic, comprising the steps of:

arranging the beaded brush strips with the beaded portions and bristle filaments adjacent each other in aligned side-by-side relation;

positioning at least one barrier fin of synthetic resinous material between the beaded brush strips and aligned therewith with a side edge region of the fin and beaded portions forming a sandwich; and subjecting the sandwich to heat wherein the beaded portions and side edge region of the fin are fused and formed so as to enable the brush component to be secured to a support.

27. A method according to claim 26 wherein a strengthening wire is incorporated in said fused beads.

28. A method according to claim 26 wherein at least one barrier layer is incorporated into the brush component.

29. A method according to claim 26 wherein the two brush strips are inclined relative to each other when viewed from the end.

30. A method of manufacturing a brush component from at least two brush tapes, one tape formed of a plurality of synthetic resinous bristle filaments of one characteristic, and the other tape formed of a plurality of synthetic resinous bristle filaments of a different characteristic, each tape having a uniform cross-section from one side edge region to the opposite side edge region, comprising the steps of:

arranging the brush tapes with the bristle filaments adjacent each other in aligned side-by-side relation;

positioning at least one barrier fin of synthetic resinous material between the brush tapes and aligned therewith with a side edge region of the fin and side edge regions of the tapes forming a sandwich;

subjecting the sandwich to heat in a fusion head wherein the side edge regions of the fins and tapes are fused together; and forming the fused side edge regions of the fin and tapes into a mounting portion enabling the brush component to be secured to a support.

* * * * *